United States Patent [19]

Sepulveda

[11] Patent Number: 4,500,863

[45] Date of Patent: Feb. 19, 1985

[54] CIRCUIT BREAKER HAVING AN INTEGRATED POWER TRAP ARM

[75] Inventor: Luis F. Sepulveda, Fajardo, P.R.

[73] Assignees: Challenger Caribbean Corporation, Canovanas; Challenger Zinsco, Inc., Rio Piedras, both of P.R.; Commander Electrical Equipment, Inc., Scarborough, Canada

[21] Appl. No.: 507,609

[22] Filed: Jun. 24, 1983

[51] Int. Cl.[3] ..... H01H 73/24

[52] U.S. Cl. ..... 337/70; 335/175

[58] Field of Search ..... 337/68, 70; 335/25, 335/175; 200/67 PK, DIG. 42

[56] References Cited

U.S. PATENT DOCUMENTS 2,627,564 2/1953 Ericson ..... 200/67 PK 4,032,875 6/1977 Belttary ..... 337/70

*Primary Examiner*—Harold Broome

*Attorney, Agent, or Firm*—Sperry, Zoda & Kane

[57] ABSTRACT

A circuit breaker includes a fixed contact, a pivotable contact carrier having a movable contact for engagement with the fixed contact, a pivotable trip arm, a latch adapted to latch the trip arm, a thermostatic element adapted to engage the latch, and an overcenter spring coupled between the contact carrier and the trip arm. In the event of an overcurrent, the latch releases the trip arm, and the overcenter spring retracts the contact carrier, disengaging the contacts. An improved trip arm includes an integrally formed, perpendicularly extending lug which strikes the contact carrier, providing an impact force to disengage the contacts in the event of welding of contacts together.

3 Claims, 4 Drawing Figures

CIRCUIT BREAKER HAVING AN INTEGRATED POWER TRAP ARM

BACKGROUND OF THE INVENTION

1. Field of the Invention

This invention relates to new and improved circuit breakers and, in particular, to circuit breakers utilizing an integrated power-trip arm. Accordingly, it is a general object of this invention to provide new and improved devices of such character.

2. Description of the Prior Art

In a residential type circuit breaker of the prior art, it had been the common practice to utilize a connector that was mounted in an insulated housing. The connector was adapted to engage a line bus when the breaker was inserted into a distribution panel box. A fixed contact was affixed to the connector. A movable handle, which had a slot therein, was mounted in the housing. An actuator plate, pivotable about a fixed point on the housing, had a leg for pivotal engagement within the slot. The plate had a boss protruding perpendicular to its otherwise planar body. A movable contact carrier had a pivotal point of connection at one end thereof. A contact was provided at the opposite end thereof for movable engagement with and disengagement from the fixed contact. A first end of a slotted plate was adapted to pivot within an indentation of the housing. An opposite end of the plate was adapted to pivotally engage with the pivotal point of connection. The slotted plate was provided with a slot which received the boss. A trip arm had one end thereof adapted to pivot about a pivot axis of the housing and had a portion thereof adapted to engage an overcenter tension spring that was coupled between the portion and a point on the contact carrier other than the pivotal point. A biasing tension spring was coupled between the contact carrier and the leg on the actuator plate. A latch was provided which was pivotable about a second pivot axis of the housing. The latch had a pair of latching extremities and had a limiting portion to limit extent of rotation in one direction. One of the latching extremities was adapted to engage with the latching end of the trip arm. A load terminal included means for a load conductor to be coupled to the circuit breaker. A thermally responsive latching member had one end coupled to the load terminal and had an opposing end adapted to engage the other of the latching extremities of the latch. A flexible conductor conductively connected the contact carrier to the latching member.

Disadvantageously, the foregoing prior art circuit breaker would occasionally result in the contacts being welded together. Obviously, the welding of circuit breaker contacts to each other is undesirable, unreliable, and hazardous. The welding of the circuit breaker contacts to each other could be avoided by an increase in power that was used in the circuit breaker, but such increased use of power is expensive.

More recently, a circuit breaker having similar elements was provided wherein the breaker was initially reset by moving the handle in one direction, pushing the trip arm into a latch. In turn, the latch got engaged by the bimetal thermostatic element. When the bimetal thermostatic element got overheated and deflected, it released the latch which, in turn, released the trip arm. The trip arm, then, impacted a separate power arm, a small device which then, in turn, impacted the moving arm. Disadvantageously, however, the extra power arm, being an extra piece, provided increased cost in both the producing and the mounting of same. The extra piece had an inherent short life. The mounting of the extra piece slowed production compared to the previous device by approximately eight percent.

With the instant invention, production rates equal to what they were, prior to the separate power arm, are achievable.

SUMMARY OF THE INVENTION

Another object of this invention is to provide a new and improved circuit breaker having fewer parts than corresponding circuit breakers of the prior art.

Yet another object of this invention is to provide a new and improved circuit breaker in which a stamped metal part which has been used in similar devices is eliminated.

Still another object of the invention is to provide a new and improved circuit breaker in which a power arm of the prior art and a trip arm of the contemporary art is integrated into one piece to simplify and improve performance.

Yet still another object of this invention is to provide a new and improved circuit breaker which is less costly in materials and labor, and which has improved quality.

In accordance with one embodiment of this invention, novel features in a circuit breaker including a pivotable contact carrier and a latch include a pivotable trip arm adapted to be latched by the latch and having an integrally formed, perpendicularly extending, impact lug for strikable engagement with the contact carrier. An overcenter spring is coupled between the contact carrier and the trip arm.

In accordance with another embodiment of the invention, a circuit breaker includes, in combination, a housing of insulating material. A connector, adapted to engage a line bus when the breaker is inserted into a distribution panel box, is mounted in the housing. A fixed contact is affixed to the connector. A movable handle, having a slot therein, is mounted in the housing. An actuator plate, pivotable about a fixed point on the housing, has a leg for pivotal engagement within the slot and a boss protruding perpendicular to the plate. A movable contact carrier having a pivotal point of connection at one end thereof, has a contact at its opposite end for movable engagement with and disengagement from the fixed contact. A first end of a slotted plate is adapted to pivot within an indentation of the housing. An opposite end of the plate is adapted to pivotally engage with the pivotal point of connection, the plate having a slot for receiving the boss. One end of a trip arm is adapted to pivot about a pivot axis of the housing. An opposing latching end of the trip arm has an integrally formed, perpendicularly extending, impact lug which can strikably engage with the contact carrier. A portion of the trip arm is adapted to engage an overcenter tension spring which is coupled to a point on the contact carrier other than the pivotal point. A biasing tension spring is coupled between the contact carrier and the leg of the actuator plate. A latch is pivotal about a second pivot axis of the housing, the latch having a pair of latching extremities and a limiting portion to limit the extent of rotation in a first rotatable direction. One of the latching extremities is adapted to engage with the latching end of the trip arm. A load terminal includes means for a load conductor to be coupled to the circuit breaker. One end of a thermally responsive latching means is coupled to the load terminal. An opposing end of the thermally responsive latching means is adapted to engage with the other latching extremity of the latch. A flexible conductor conductively connects the contact carrier to the latching member. In accordance with certain features of the invention, movement of the handle to one position both disengages the contacts from each other and engages the opposing end of the latching member with the other latching extremity of the latch. Subsequent movement of the handle to an opposite position engages the contacts while continuing the engagement of the opposing end of the latching member with the latching extremity of the latch.

In accordance with another embodiment of the invention, a circuit breaker includes, in combination, a housing of insulating material in which a connector is mounted therein, the connector being adapted to engage a line bus when the breaker is inserted into a distribution panel box. A fixed contact is affixed to the connector. A movable handle which has a slot therein is mounted in the housing. An actuator plate, pivotable about a fixed point in the housing, has a leg for pivotal engagement within the slot and has a boss protruding perpendicular thereto. One end of the movable contact carrier has a pivotal point of connection, the contact carrier having a contact at an opposite end thereof for movable engagement with and disengagement from the fixed contact. A first end of the slotted plate is adapted to pivot within an indentation in the housing. An opposite end of the plate is adapted to pivotally engage with the pivotal point of connection. The plate has a slot for receiving the boss. One end of a trip arm is adapted to pivot about a pivot axis of the housing. An opposing end of the trip arm is provided with a latching end; the trip arm has a spring engaging portion. An overcenter tension spring is coupled between the spring engaging portion and a point on the contact carrier other than the pivotal point. A biasing tension spring is coupled between the contact carrier and a leg on the actuator plate. A latch is pivotal about a second pivot axis of the housing, the latch having a pair of latching extremities and having a limiting portion to limit extent of rotation in a first rotational direction. One of the latching extremities is adapted to engage with the latching end of the trip arm. A load terminal includes means for a load conductor to be coupled to the circuit breaker. One end of a thermally responsive latching member is coupled to the load terminal and the latching member further includes an opposing end which is adapted to engage the other latching extremity of the latch. A flexible conductor conductively connects the contact carrier to the latching member. The improvement in the foregoing resides in that the trip arm is provided with an integrally formed, perpendicularly extending, impact lug for strikable engagement with the contact carrier. In accordance with certain features of the invention, movement of the handle to one position both disengages the contacts from each other and engages the opposing end of the latching member with the other latching extremity of the latch and subsequent movement of the handle to an opposite position engages the contacts while continuing the engagement of the opposing end of the latching member with said other latching extremity of said latch. In such a circuit breaker, wherein prolonged overcurrent causes the thermally responsive latching member to deflect, disengaging the other latching extremity of the latch, and pivoting the trip arm, causing the overcenter spring to apply a force on an opposite side of the pivotal point of connection, the contacts disengage. The improvement in the foregoing resides in that the trip arm is integrally formed with a perpendicularly extending impact lug for strikable engagement with the contact carrier, upon pivoting of the arm, to assure that the contacts do not weld to each other.

BRIEF DESCRIPTION OF THE DRAWINGS

Other objects, advantages and features of this invention, together with its construction and mode of operation, will become more apparent from the following description, when read in conjunction with the accompanying drawing, in which.

DESCRIPTION OF PREFERRED EMBODIMENT(S)

Figure 1:
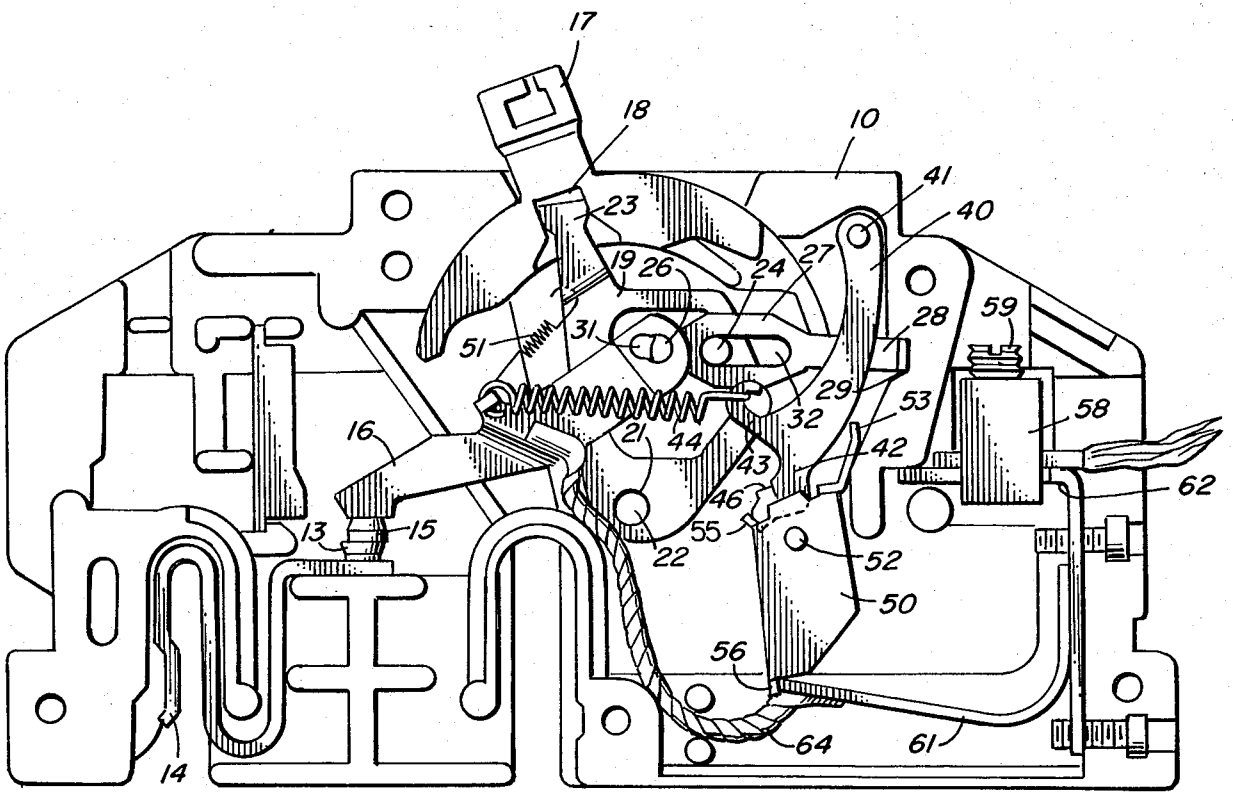
FIG. 1 is a view of a circuit breaker in accordance with one embodiment of the invention, with the cover removed, depicting the circuit breaker in the "on" condition.

A circuit breaker in accordance with the present invention, as illustrated in the drawing, includes a housing comprising a case 10 of suitable insulating material and a cover (not shown) of similar material. The case and cover are typically of molded plastic. The various elements of the circuit breaker mechanism are mounted within the case 10 and are held in place by the cover which is riveted to the case.

A fixed contact 13 is mounted on a clip 14 which is designed to engage a line bus when the breaker is inserted into a distribution panel box. A moving contact 15 is mounted on a contact carrier 16. A handle 17 of insulating material is pivotally mounted within the case 10 in a manner for a manual operation which will become more apparent from the description to be provided hereinafter.

The handle 17 is provided with a slot 18 at one side thereof, generally oriented in a radial direction with respect to the handle 17.

An actuator or pivot plate 19 is provided with a circular hole 21 therein so as to slidably engage with an upstanding projection 22 from the housing 10 so that the actuator plate 19, in effect, is pivotable about a fixed point on the housing 10. The actuator plate 19 contains a leg 23 suitable for pivotable engagement within the slot 18. The actuator plate 19 is further provided with a boss 24 which protrudes perpendicular from its planar body.

The contact carrier 16 has a pivotable point of connection at one end 26 thereof. The end 26 of the moving contact 16 (in the embodiment depicted) includes a circular hole adapted to engage with a protrusion from a slotted plate 27, to be discussed in greater detail hereinafter. The movable contact carrier 16, as stated, has a pivotable point of connection at one end, and it has the movable contact 15 at the opposite end. The contact 15 thus is adapted for a movable engagement with and disengagement from the fixed contact 13.

One end 28 of the slotted plate is adapted to pivot within an indentation 29 within the housing 10. The opposite end 31 of the plate 27 engages within the hole 26 or pivotal point of connection of the moving carrier 16 so that the end 31 of the slotted plate 27 and the hole 26 of the moving plate 16 jointly operate in a pivotal configuration. The slotted plate 27, of course, is provided with a slot 32 which is adapted to receive the boss 24 which is attached to the actuator plate 19.

A trip arm 40 has one end thereof affixed in a pivotal connection to the housing 10 by way of a pin 41 so that the trip arm 40 is pivotable about the axis of the pin 41 with respect to the housing 10. The opposite end of the trip arm 40 is provided with a latching end portion 42. The trip arm 40 is further provided with a hook 43 in such a manner so that it can engage an overcenter tension spring 44. The other end of the tension spring 44 is coupled to a midpoint of the moving contact 16. The trip arm 40 is provided with an integrally formed, perpendicularly extending, impact lug 46 which is adapted to be in striking engagement with the contact carrier 16 upon release of the latched end 42 from the latch 50 as will become more apparent in greater detail hereinafter.

A biasing spring 51 is coupled between the contact carrier 16 and the leg 23 of the actuator plate 19.

The latch 50 is pivotable about a pivot pin 52 which is engaged within a suitable indentation in the housing 10 so that the latch 50 can rotate about the axis of the pin 52 within a limited range. The range is limited by an extending arm 53 which, in an extreme condition, rests against an edge of a protrusion from the housing 10.

The latch 50 is pivotable about the axis of the pin 52 and has an extending arm 53 to limit rotation in one direction. The latch 50 has a pair of latching extremities 55, 56. The extremity 55 is adapted to engage with the latching end 42 of the trip arm 40.

A load terminal 58 is provided with a screw 59 to enable a load conductor (not shown) to be coupled to the circuit breaker.

A thermally responsive latching member 61, which can be a bimetallic element, has one end coupled to the load bar 62 which is affixed to the load terminal 58. The opposite end of the bimetallic thermostatic element 61 is adapted to engage the latching extremity 56 of the latch 50.

A flexible conductor 64 conductively connects the contact carrier 16 to the latching member 61.

Figure 2:
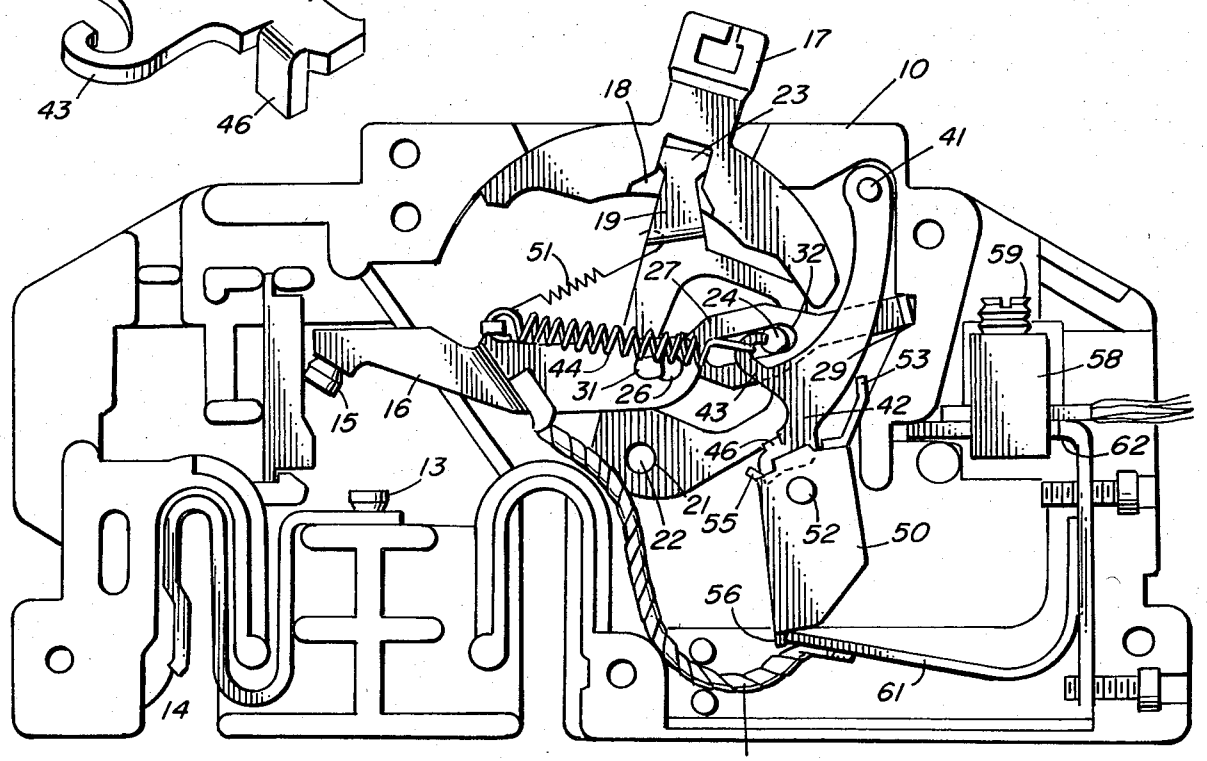
FIG. 2 is a view of the circuit breaker depicted in FIG. 1, but with the circuit breaker shown in the "set" or "off" condition.
Figure 4:
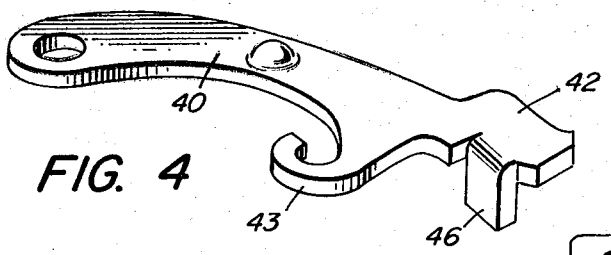
FIG. 4 is a view of the trip arm used in a preferred embodiment of the invention.
Figure 3:
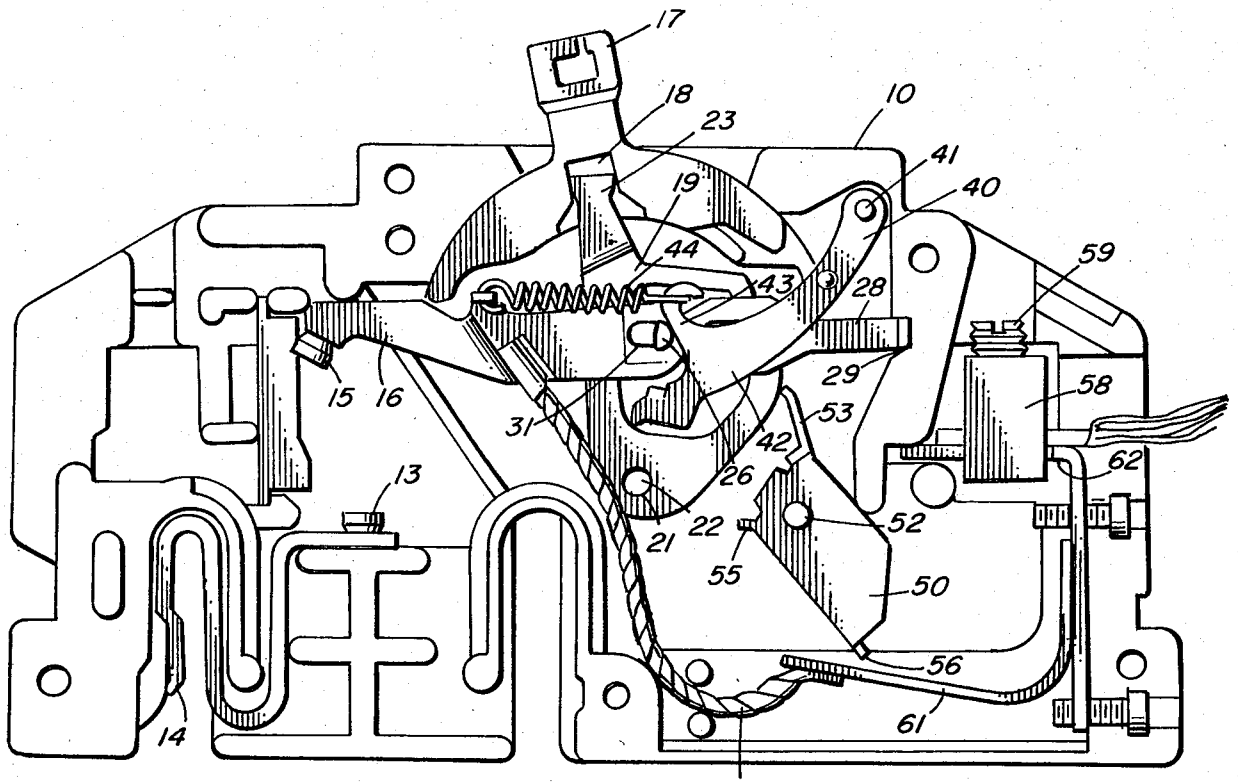
FIG. 3 is a view of the circuit breaker of FIGS. 1 and 2 in the "tripped" condition.

Assume for some reason or other that the circuit breaker had been placed in the tripped condition as depicted in FIG. 3:

To reset the breaker, the handle 17 is moved to the right as depicted in the drawing. Moving the handle 17 towards the right pushes the trip arm 40 into engagement with the latch 50. The latch 50, in turn, becomes engaged by the bimetallic thermostatic element 61, as depicted in FIG. 2.

The circuit breaker switch handle 17 is then moved to the left. By moving the handle to the left, the pivot point of connection 26 traverses to the opposite end of the overcenter spring 44, whereby the contact carrier 16 moves toward the clip 14, whereby the contacts 15 and 13 engage.

In operation, normally, current travels through the clip 14, the fixed contact 13, the moving contact 15, the contact carrier 16, the flexible conductor 64, the bimetallic thermostatic element 61, the load bar 62, and the load terminal 58, and the circuit breaker remains in a quiescent state.

During an abnormal condition, excessive current flows through the circuit breaker. The overcurrent causes the bimetallic thermostatic element 61 to deflect, unlatching the latch 50. The latch releases the trip arm 40 so that the overcenter spring 44, by traversing the pivot point of connection 26, retracts the moving contact 15 from the fixed contact 13. Release of the trip arm 40 toward the contact carrier 16 assures that the integrally formed, perpendicularly extending, impact lug 46 (effectively an integrated power-trip arm) directly strikes and impacts the contact carrier 16 to apply a positive impact force to separate the contacts 15 and 13 from each other.

A product manufactured in accordance with this invention has longer life, improved quality, and can be manufactured faster and with less cost than similar products of the prior art.

What is claimed is:

1. In a circuit breaker of the type including a contact carrier pivoted for movement between circuit-closing and -opening positions respectively, a tension spring connected at one end to the contact carrier, a latch pivoted to swing between a latching and a release position, and a thermostatic element that normally restrains the latch from movement to its release position and deflects in the presence of an overload current to free the latch for movement to its release position, the improvement comprising a one-piece, generally flat trip arm one end of which provides a pivot axis about which the arm is swingable between retracted and tripping positions respectively, the trip arm having a midportion connected to the other end of the spring, the spring being tensioned to bias the trip arm toward the contact carrier, the trip arm at its other end having an end portion formed for engagement with the latch when the trip arm and latch are in their retracted and latching positions respectively, the trip arm being further integrally formed at said other end thereof with an impact lug extending perpendicularly to the general plane of the arm in a direction such that when the trip arm swings to its tripping position with the contact carrier in its circuit closing position, the carrier will be in the path of the lug and will be impacted thereby and driven to its circuit-opening position.

2. In a circuit breaker the improvement of claim 1 wherein said latching end portion and impact lug are in side-by-side relation.

3. In a circuit breaker the improvement of claim 2 wherein said latching end portion is leading in the sense of the direction in which the trip arm moves when swinging from its tripping to its retracted position, and the impact lug is leading in the sense of the direction in which the arm moves when swinging from its retracted to its tripping position.

* * * * *